US007520069B2

(12) United States Patent
Workman et al.

(10) Patent No.: US 7,520,069 B2
(45) **Date of Patent: *Apr. 21, 2009**

(54) SHOE HAVING A REPLACEABLE SOLE

(75) Inventors: Robert Workman, Canby, OR (US); Brian Chaney, Portland, OR (US)

(73) Assignee: Omni Trax Technology Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/752,221

(22) Filed: May 22, 2007

(65) Prior Publication Data

US 2007/0271816 A1 Nov. 29, 2007

Related U.S. Application Data

(63) Continuation of application No. 10/925,605, filed on Aug. 24, 2004, now Pat. No. 7,331,123.

(51) Int. Cl.
*A43C 13/00* (2006.01)

(52) U.S. Cl. ..... 36/15; 36/100

(58) Field of Classification Search ..... 36/15, 36/100, 101

See application file for complete search history.

(56) References Cited

U.S. PATENT DOCUMENTS 1,542,174 A 6/1925 Robidoux
2,640,283 A 6/1953 McCord
3,538,628 A 11/1970 Einstein, Jr.
3,866,339 A 2/1975 Latto
3,902,259 A 9/1975 Cracco
4,062,132 A * 12/1977 Klimaszewski ..... 36/100
4,279,083 A 7/1981 Dilg
4,317,294 A 3/1982 Goodyear
4,377,042 A 3/1983 Bauer
4,745,693 A 5/1988 Brown
5,317,822 A 6/1994 Johnson
5,410,821 A 5/1995 Hilgendorf
5,533,280 A 7/1996 Halliday
5,644,857 A 7/1997 Ouellette et al.
5,657,558 A 8/1997 Pohu (Continued)

FOREIGN PATENT DOCUMENTS

DE 8713580 U1 2/1989

(Continued)

OTHER PUBLICATIONS

European Search Report and written opinion dated for related European application No. 07009627.6 dated Aug. 27, 2007, 9 pages.

(Continued)

*Primary Examiner*—Marie Patterson
(74) *Attorney, Agent, or Firm*—Ganz Law, P.C.

(57) ABSTRACT

A sole plate assembly comprising a sole plate with at least two or more engageable elements disposed along a peripheral portion of the sole plate, the engageable elements each being adapted to engage a complementary engageable element associated with a sole to form a male-female pair of elements that provide an interference fit that helps secure the sole plate to the sole; and a sole adapted to receive the sole plate.

24 Claims, 4 Drawing Sheets

U.S. PATENT DOCUMENTS

| | | | | |
|---|---|---|---|---|
| 5,661,915 | A | 9/1997 | Smith | |
| 5,692,322 | A | 12/1997 | Lombardino | |
| 5,761,833 | A | 6/1998 | McMullin | |
| 5,836,090 | A | 11/1998 | Smith | |
| 5,956,870 | A | 9/1999 | Grossman et al. | |
| 5,996,252 | A | 12/1999 | Cougar | |
| 6,345,454 | B1 | 2/2002 | Cotton | |
| 6,389,712 | B1 | 5/2002 | Schelling | |
| 6,442,869 | B2 * | 9/2002 | Coomes | 36/11.5 |
| 6,481,121 | B1 | 11/2002 | Tucker | |
| 6,813,847 | B2 | 11/2004 | Workman | |
| 7,331,123 | B2 * | 2/2008 | Workman et al. | 36/15 |
| 2001/0042319 | A1 * | 11/2001 | Coomes | 36/11.5 |
| 2002/0004996 | A1 | 1/2002 | Scheucher | |
| 2003/0200675 | A1 | 10/2003 | Gross | |
| 2004/0088883 | A1 * | 5/2004 | Workman | 36/15 |
| 2004/0237347 | A1 * | 12/2004 | Meschan | 36/42 |
| 2005/0120589 | A1 * | 6/2005 | Coomes | 36/15 |
| 2005/0274042 | A1 * | 12/2005 | Issler | 36/15 |
| 2006/0107552 | A1 * | 5/2006 | Clark et al. | 36/97 |
| 2006/0107553 | A1 * | 5/2006 | Clark et al. | 36/97 |
| 2006/0130364 | A1 * | 6/2006 | Greene et al. | 36/28 |
| 2007/0227039 | A1 * | 10/2007 | Chaney et al. | 36/15 |
| 2007/0271816 | A1 * | 11/2007 | Workman et al. | 36/15 |

FOREIGN PATENT DOCUMENTS

| | | | |
|---|---|---|---|
| EP | 0153136 | | 8/1985 |
| FR | 2790370 | A1 | 9/2000 |
| FR | 2864882 | A1 | 7/2005 |
| GB | 2366508 | A | 3/2002 |
| JP | 05-211901 | | 8/1993 |

OTHER PUBLICATIONS

English Abstract of International PCT Publication No. WO 2005/072547, published Aug. 11, 2005, inventor name is Christophe Rovida, 1 page.

Canadian Office Action dated Oct. 14, 2008, 5 pages.

Canadian Office Action dated Apr. 30, 2008 for related Canadian patent application No. 2,521,918, filed Sep. 30, 2005; 4 pages.

* cited by examiner

SHOE HAVING A REPLACEABLE SOLE

CROSS REFERENCE TO RELATED APPLICATIONS

Under 35 U.S.C. 120, this application is a Continuation of, claiming the benefit of and priority to, U.S. patent application Ser. No. 10/925,605, filed Aug. 24, 2004, now U.S. Pat. No. 7,331,123 the contents of which are hereby incorporated by reference as if recited in full herein for all purposes.

BACKGROUND AND SUMMARY

This invention relates to a shoe having a sole that can be quickly and easily replaced with other soles having different types of traction surfaces.

Shoes having replaceable soles are well known in the prior art. One such shoe, which is particularly adapted for use by fishermen, is sold by Korkers Products, LLC. This shoe is disclosed in patent application Ser. No. 10/293,188, now U.S. Pat. No. 6,813,847. This shoe includes a cavity in its sole which receives a sole plate having a tread pattern on its lower surface. A tab located at the front of the sole plate fits into a slot formed in the cavity sidewall to hold the front end of the sole plate in place. A strap, which is attached to the rear of the sole plate, can be attached to an attachment device located at the back of the shoe to hold the rear end of the sole plate in place. A piece of interfitting releasable fastener material may be located on the sole plate and sole near the center of the sole plate to hold the center of the sole plate in place.

While this shoe works well for its intended purpose, it does have several shortcomings. First, the interfitting releasable fastener loses its holding ability with repeated use, particularly when exposed to sand. Second, sand can get in the slot at the front of the cavity and cause the front end of the sole plate to become offset downwardly with respect to the remainder of the sole. Finally, the attachment device at the rear of the shoe which receives the strap attached to the rear of the sole plate is cumbersome to use, particularly in the field.

The subject invention overcomes the foregoing shortcomings of the prior art shoes having replaceable sole plates by providing a sole having a thin cavity which releasably receives a sole plate which substantially fills the cavity. The sidewall of the cavity includes flaps which are contiguous with the bottom surface of the sidewall and have a thickness which is less than the thickness of the cavity. Depressions located in the outer surface of the sole plate are arranged to receive the flaps when the sole plate is pushed past the flaps into the cavity. The flaps then hold the sole plate in the cavity.

In another aspect of the invention, a slot is located in the sidewall of the cavity at the toe end of the shoe and the sole plate has a tab at its front end which fits into the slot. In this embodiment the sidewall includes a ledge which extends into the cavity below the slot and the sole plate has a recess which is located below the tab and receives the ledge. Thus, when the sole plate is placed in the cavity the ledge and recess interfit to prevent sand from getting under the tab.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
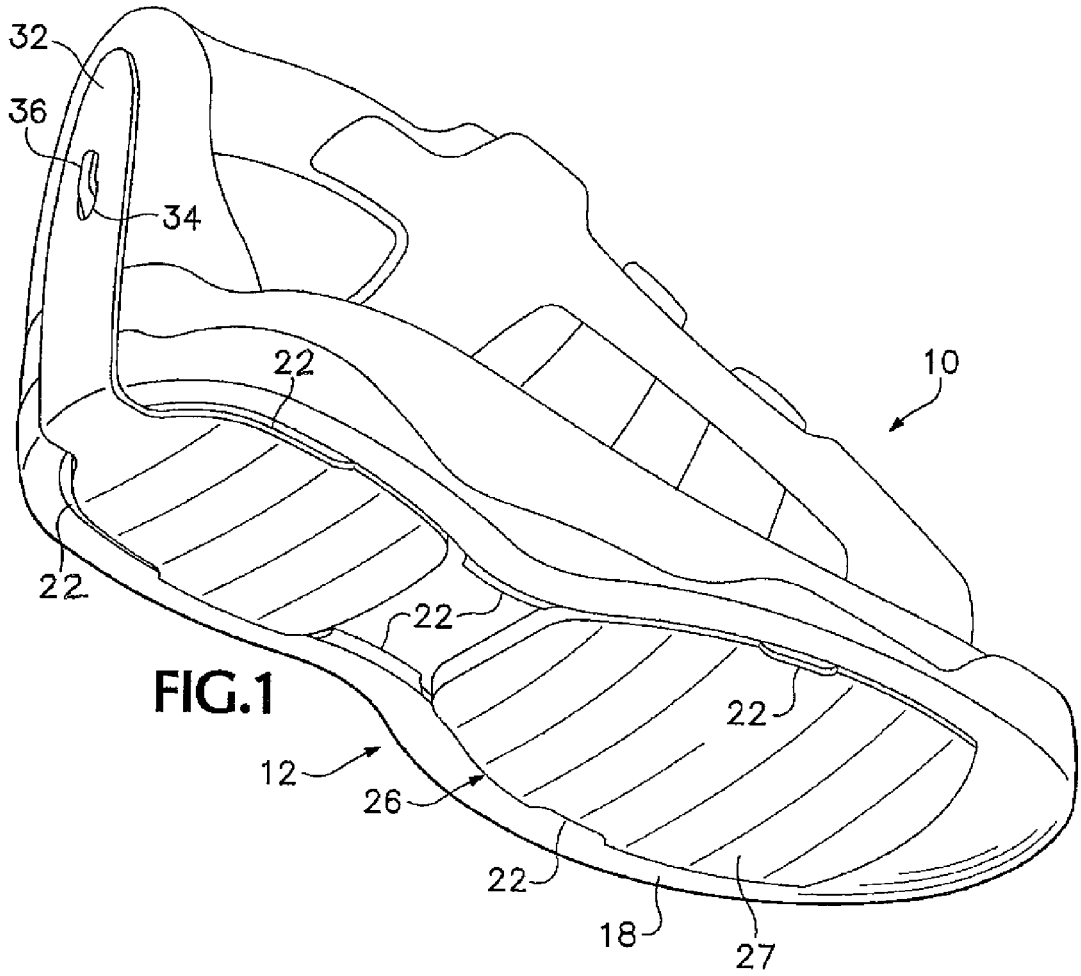
FIG. 1 is a perspective view of a shoe with a removable sole plate embodying the subject invention.
Figure 2:
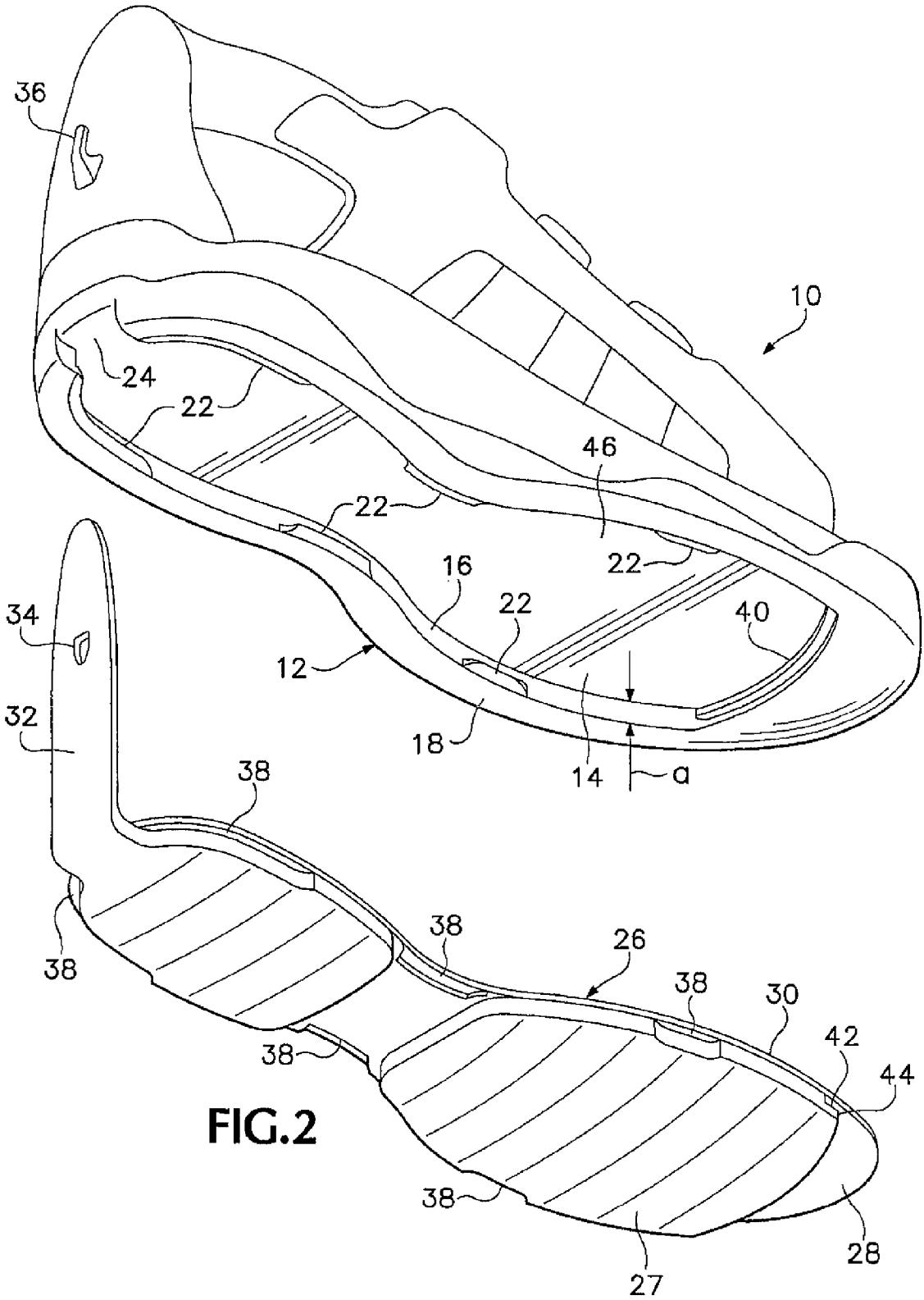
FIG. 2 is an exploded view of the shoe of FIG, 1 showing the sole plate removed from the remainder of the shoe.
Figure 3:
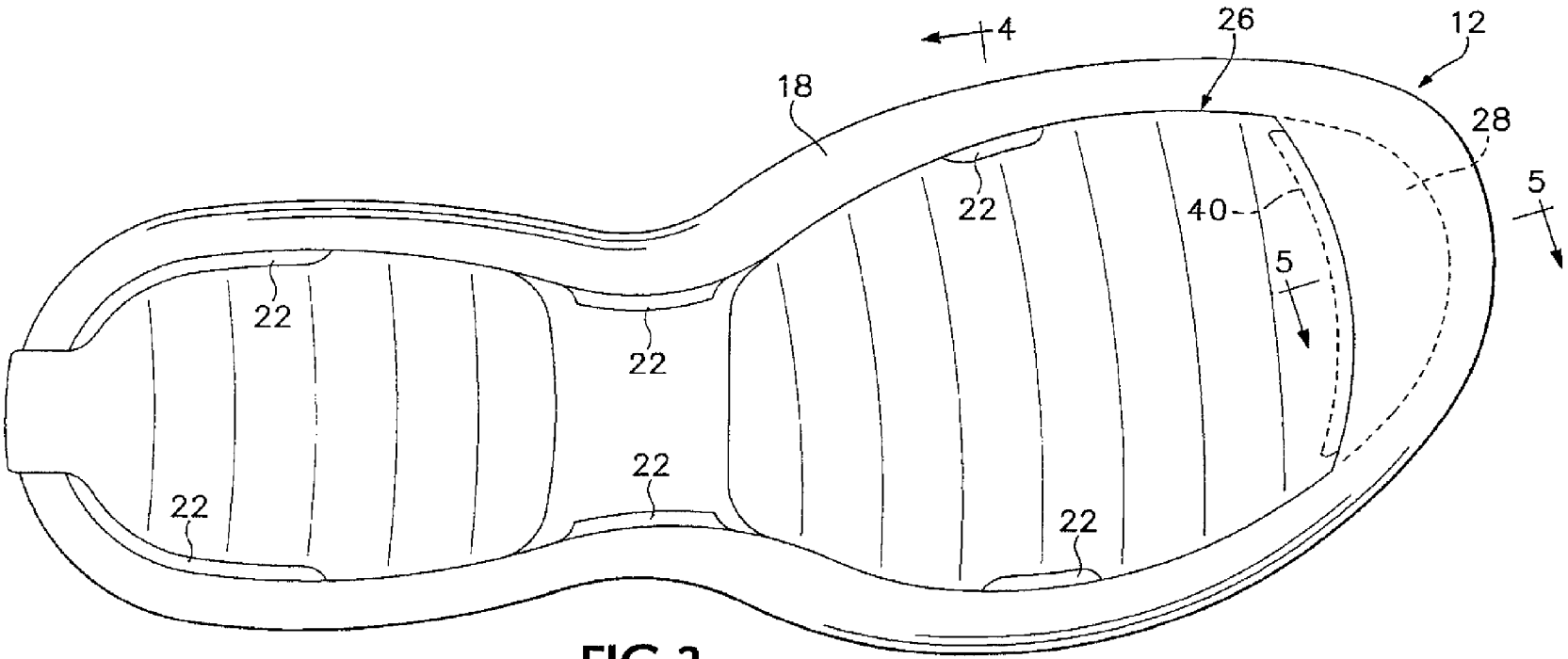
FIG. 3 is a bottom view of the shoe of FIG. 1.
Figure 4:
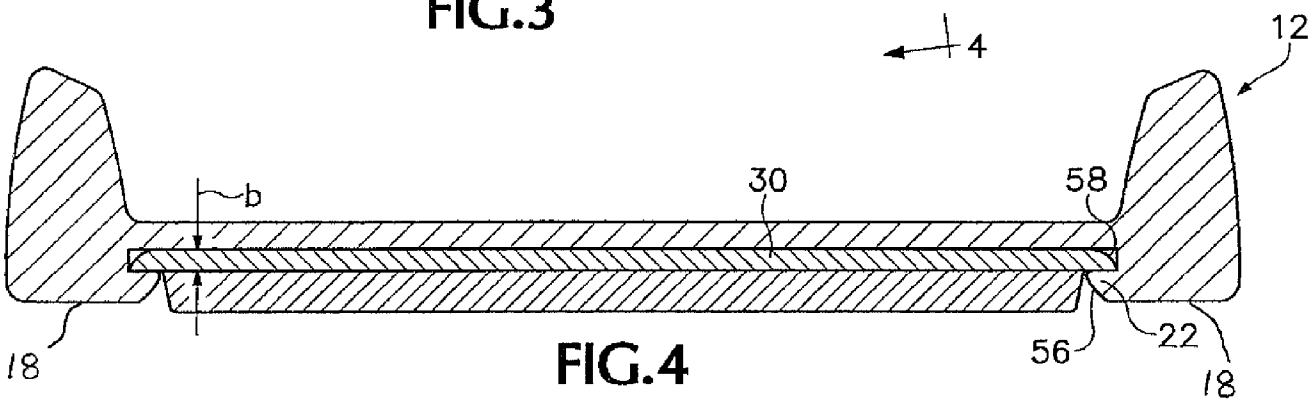
FIG. 4 is a sectional view, at an enlarged scale, taken on the line 4-4 in FIG. 3.
Figure 5:
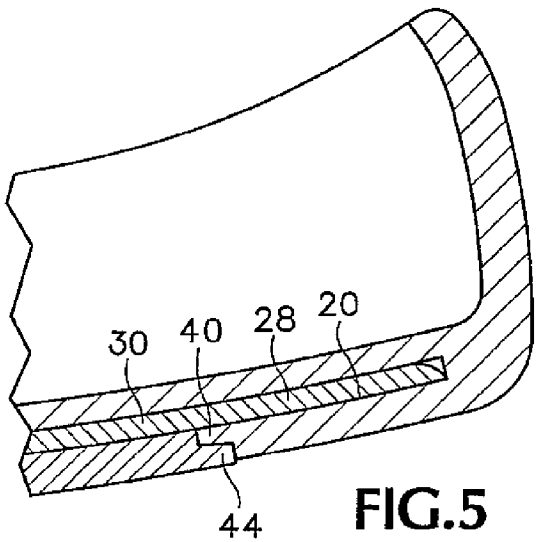
FIG. 5 is a cross-sectional view, at an enlarged scale, taken on the line 5-5 of FIG. 3.

The subject invention is referred to as a shoe, however it could be a boot or sandal as well and the word shoe is meant to cover any type of footwear. Referring now to FIGS. 1 and 2 of the drawings, a shoe 10 has a sole 12 with a thin cavity 14 located centrally in it. The cavity is surrounded by a sidewall 16 having a bottom surface 18, which is part of the shoe tread. The sidewall has a thickness a, which in the embodiment illustrated is approximately one-quarter inch. Located in the sidewall at the toe end of the cavity 14 is a thin slot 20, FIG. 5. The slot 20 preferably is at the top of the cavity 14. Located around the periphery of the cavity 14 are a plurality of flaps 22. The bottoms of the flaps are contiguous with the bottom surface 18 of the sidewall and they have a thickness b, FIG. 4, which is less than the thickness a. In the embodiment illustrated the flaps are located in pairs with one flap in each pair being on each side of the shoe. One pair of flaps 22 is located around where the ball of the user's foot would be, one pair is located around where the arch of the user's foot would be, and another pair is located around where the user's heel would be. The sidewall 18 includes a passageway 24 at its back edge which extends between the cavity 14 and the back of the shoe.

A sole plate 26 is sized to fit within and substantially fill the cavity 14. The sole plate has generally the same thickness as the thickness of the sidewall, however, due to the tread pattern located on the bottom surface 27 of the sole plate its thickness varies. In any event, the bottom surface of the sole plate is generally flush with the bottom surface 18 of the sidewall 16 in order to provide a stable bottom on the shoe. The sole plate is made from an elastomeric material and preferably has a flexibility that is similar to that of the sole 12. A thin tab 28 located at the toe end of the sole plate fits into the slot 20 when the sole plate is inserted into the cavity. In the embodiment illustrated the tab is an extension of a thin base layer 30 which forms the upper portion of the sole plate. The base layer is made from a plastic material, such as ABS, and is far less flexible than the remainder of the sole plate. In a preferred embodiment the base layer is glued to the remainder of the sole plate, but it could be joined by other means. Alternatively, there could be no base plate and the tab 28 could be integral with the rest of the sole plate.

Located at the heel end of the sole plate is a strap 32 which extends through the passageway 24 and up the back of the shoe. The strap is made from an elastically deformable material and has an opening 34 located near its end. A hook 36 located on the back of the shoe is configured to receive the opening. After the sole plate is placed in the cavity the strap is stretched to place the opening 34 over the hook 26 and when the strap is released its elasticity holds the rear end of the sole plate on the shoe.

Located around the periphery of the bottom surface of the sole plate are a plurality of depressions 38 which are arranged to receive the flaps 22 when the sole plate is inserted into the cavity. In the embodiment illustrated the depressions 38 extend to the more rigid base layer 30.

The flaps 22 are elastically deformable and are flexible enough to be deflected upwardly to allow the portions of the base layer located above the depressions 38 to be snapped in place above the flaps when the sole plate is inserted into the cavity. Accordingly, the flaps and depressions may be considered engageable elements, each forming a male-female pair that provides an interference fit that helps secure the sole plate to the sole. However, the flaps are sufficiently stiff to hold the sole plate in place once the base layer is pushed past the flaps. In the embodiment illustrated the bottom edges 56 of the flaps 22, and the top edges 58 of the portions of the base layer 30 located above the depressions 38 are rounded to facilitate pushing the base layer past the flaps. The flaps are somewhat harder than the remainder of the sidewall. Preferably, the flaps have a hardness of between 90 and 95 Shore A Durometer and the remainder of the sidewall has a hardness of between 80 and 85 Shore A Durometer.

A ledge 40 extends from the sidewall 18 into the cavity 14 below the slot 20. The sole plate 26 includes a recess 42 which is located below the tab 28 and is configured to receive the ledge 40 when the sole plate is placed in the cavity. Thus the tip 44 of the sole plate which is below the recess 42 overlaps the ledge 40 and prevents sand from working its way into the slot 20 and forcing the tab outwardly causing a discontinuity between the outer surface of the sole plate and the outer surface of the sidewall at the toe end of the shoe.

Figure 6:
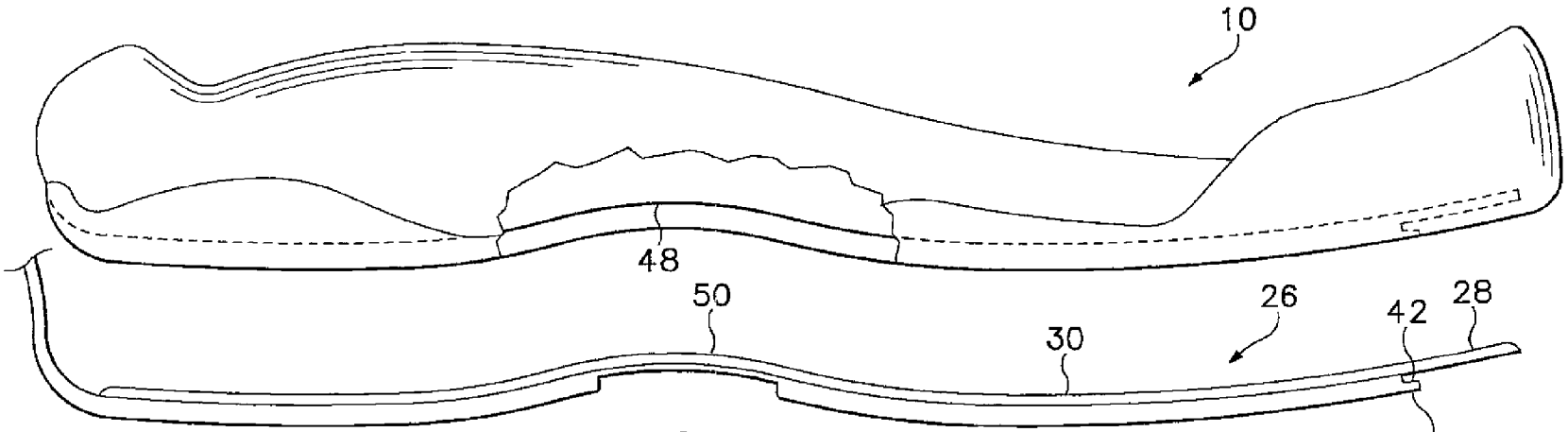
FIG. 6 is an exploded side elevation, partially broken away, of the shoe of FIG. 1.

While the use of the interlocking tab 28 and slot 20 at the toe end, the strap 32 and hook 36 at the heel end and the flaps 22 in between all prevent the sole plate from being pulled out of the shoe perpendicular to the sole plate, if the sole plate is strongly urged rearwardly it might pull free. To prevent this from occurring the top surface 46 of the cavity has an indented portion and the sole plate 26 has a projecting portion which interacts with the indented portion to prevent movement of the sole plate relative to the sole longitudinally along the shoe without first lifting the sole plate perpendicularly out of the cavity. In the embodiment shown in FIGS. 1-6 the indented portion is an inwardly facing curved surface 48 located in the arch portion of the bottom surface 46 of the cavity, as can best be seen in FIG. 6. The sole plate 26 has an upwardly facing curved surface 50 which interacts with the curved surface 48 in the top of the cavity when the sole plate is placed in the cavity.

Figure 7:
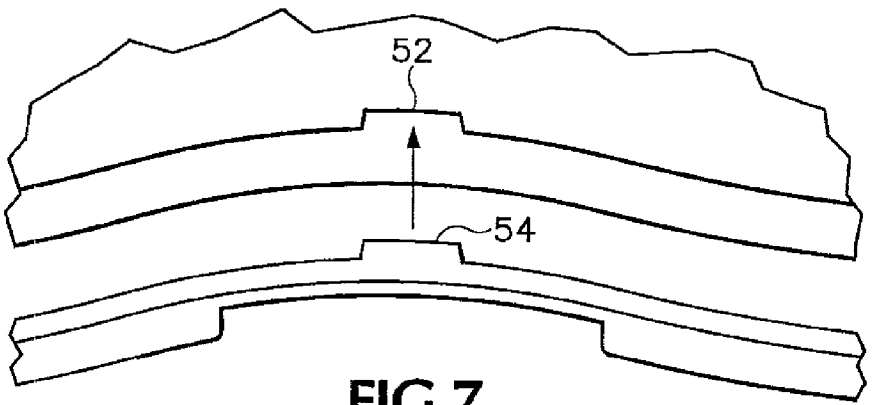
FIG. 7 is a partial side elevation view, at an enlarged scale, of another embodiment of the invention.

In another embodiment, shown in FIG. 7, the indented portion is a rectangular recess 52 which is located in the bottom surface 46 of the cavity. In this embodiment the projecting portion is a raised block 54 which fits into the recess 52 when the sole plate is placed in the cavity. The recess and block can have any shape, and can be multiple elements, such as a sawtooth pattern.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A shoe comprising:

a sole having a thin cavity located centrally in the sole and extending across the forefoot to rearfoot of the shoe, the cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements along a peripheral portion of the sole plate corresponding to the location of the engageable flaps and configured to removably fit within the gap and engage the flaps and top surface.

2. The shoe of claim 1 wherein said flaps are made from a material which is sufficiently elastically deformable to permit said sole plate to be inserted past said flaps when said sole plate is placed in said cavity and yet hold said sole plate in place in said cavity during use.

3. The shoe of claim 1 wherein said sole has a toe end and a slot is defined in said sidewall proximate said toe end and said sole plate includes a tab which fits into said slot when said sole plate is placed in said cavity.

4. The shoe of claim 1 wherein said sole has an indented portion in a top surface and said sole plate has a projecting portion which interacts with said indented portion to prevent longitudinal movement of said sole plate relative to said sole when said sole plate is placed in said cavity.

5. The shoe of claim 4 wherein said indented portion and said projecting portion are dispersed in a midfoot region of the shoe.

6. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface;

wherein said flaps are made from a material which is sufficiently elastically deformable to permit said sole plate to be inserted past said flaps when said sole plate is placed in said cavity and yet hold said sole plate in place in said cavity; and wherein said flaps are adapted to be less flexible than the remainder of said sidewall.

7. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface; and wherein said flaps are placed on opposed sides of said sole proximate the heel, the arch, and the ball of the shoe.

8. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface; and wherein said sole has a toe end and a slot is defined in said sidewall proximate said toe end and said sole plate includes a tab which fits into said slot when said sole plate is placed in said cavity;

wherein said sidewall includes a ledge which extends into said cavity below said slot and said sole plate includes a recess which is located below said tab and receives said ledge when said sole plate is placed in said cavity.

9. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface; and wherein said sole plate has a pullable element attached to said sole plate that allows the user to disengage the plate from the cavity.

10. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface;

wherein said sole plate has a pullable element attached to said sole plate that allows the user to disengage the plate from the cavity; and wherein said pullable element is elastically deformable and has a distal end adapted to engage an attachment device on the shoe.

11. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface;

wherein said sole has an indented portion in a top surface and said sole plate has a projecting portion which interacts with said indented portion to prevent longitudinal movement of said sole plate relative to said sole when said sole plate is placed in said cavity; and wherein said indented portion is an upwardly facing curved surface and said projecting portion is a mating curved surface on said sole plate.

12. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface; and wherein said flaps have rounded downwardly and inwardly facing edges.

13. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface; and wherein the engageable elements on said sole plate comprise depressions in the sole plate that correspond to the flaps.

14. A shoe comprising:

a sole having a thin cavity defined by a top surface and a sidewall extending along a peripheral portion of said sole, said sidewall having a predetermined thickness and a bottom surface;

said sidewall including a plurality of engageable flaps that in combination with the top surface of the cavity define a gap;

a sole plate sized to substantially fill said cavity;

said sole plate having a plurality of engageable elements configured to removably fit within the gap and engage the flaps and top surface;

wherein the engageable elements on said sole plate comprise depressions in the sole plate that correspond to the flaps; and wherein portions of said sole plate which are located above said depressions have rounded outwardly and upwardly facing edges.

15. A shoe comprising:

a sole having a thin cavity defined along a length and width of the sole, and located centrally in the sole and extending across the forefoot to rearfoot of the shoe, said cavity having a peripheral sidewall;

a sole plate sized to substantially fill said cavity, said sole plate having an outwardly facing traction surface;

a slot defined in said peripheral sidewall proximate said toe end of said sole;

a tab located on said sole plate which fits snugly into said slot when said sole plate is placed into said cavity;

wherein said sidewall includes a ledge which extends into said cavity below said slot and said sole plate includes a recess which is located below said tab and receives said ledge when said sole plate is placed in said cavity.

16. A shoe comprising:

a sole having a thin cavity defined along a length and width of the sole, said cavity having a peripheral sidewall;

a sole plate sized to substantially fill said cavity, said sole plate having an outwardly facing traction surface;

a slot defined in said peripheral sidewall proximate said toe end of said sole;

a tab located on said sole plate which fits snugly into said slot when said sole plate is placed in said cavity; and a a pullable element attached to said sole plate that allows the user to disengage the plate from the cavity.

17. A sole plate with at least two or more engageable elements spaced along a peripheral portion of the sole plate, the engageable elements each being adapted to engage a complementary engageable element associated with a sole to form a male-female pair of elements that provide an interference fit that helps secure the sole plate to the sole; and wherein there is a complementary pair on each side of a forefoot location and a complementary pair on each side of a rearfoot location; and the sole plate being made of a flexible material that flexes during use.

18. The sole plate of claim 17 further comprising an engageable element spaced between lateral and medial sides of the sole plate that is adapted to engage a recess in the sole and limit longitudinal movement of the sole plate relative to the sole.

19. The sole plate of claim 17 wherein the sole plate includes an engageable element in a midfoot portion spaced between lateral and medial sides of the sole plate.

20. A sole assembly comprising a sole and a sole plate with complementary pairs of engageable elements, with one or more pairs located on opposite sides of the sole assembly in each of at least forefoot and rearfoot locations in the assembly; and at least two or more engageable elements disposed along a peripheral portion of the sole plate and the engageable elements each being adapted to engage a complementary engageable element associated with a sole to form a male-female pair of elements that provide an interference fit that helps secure the sole plate to the sole and the sole plate and sole both being made of a flexible material that flexes during use.

21. The sole assembly of claim 20 wherein a pair of engageable elements comprising an indented element and a projecting element are spaced between lateral and medial sides of the sole plate and engage a recess in the sole to limit longitudinal movement of the sole plate relative to the sole received by the indented element.

22. The sole assembly of claim 20, wherein the sole includes a thin cavity defined therein along a length and width of the sole, said cavity having a peripheral sidewall; the sole plate sized to substantially fill said cavity, said sole plate having an outwardly facing traction surface and engageable elements for forming a male-female pair with complementary engageable elements on the sole.

23. A method of making a sole assembly, comprising providing a sole and a sole plate with complementary pairs of engageable elements, with one or more pairs located on opposite sides of the sole assembly in each of at least forefoot and rearfoot locations in the assembly, and at least two or more engageable elements spaced along a peripheral portion of the sole plate and the engageable elements each being adapted to engage a complementary engageable element associated with a sole to form a male-female pair of elements that provide an interference fit that helps secure the sole plate to the sole, and the sole plate and sole both being made of a flexible material that flexes during use.

24. The method of claim 23 further comprising providing a sole having a thin cavity defined therein along a length and width of the sole, said cavity having a peripheral sidewall; the sole plate sized to substantially fill said cavity, said sole plate having an outwardly facing traction surface and engageable elements for forming a male-female pair with complementary engageable elements on the sole.

* * * * *